US006112508A

United States Patent [19]

Felix

[11] Patent Number: 6,112,508

[45] Date of Patent: Sep. 5, 2000

[54] DEVICE FOR MONITORING YARNS ON RING SPINNING MACHINES

[75] Inventor: Ernst Felix, Uster, Switzerland

[73] Assignee: Zellweger Luwa AG, Uster, Switzerland

[21] Appl. No.: 09/206,239

[22] Filed: Dec. 7, 1998

[30] Foreign Application Priority Data

Dec. 17, 1997 [CH] Switzerland ..... 2890/97

[51] Int. Cl.[7] ..... D01H 7/46

[52] U.S. Cl. ..... 57/265; 57/75; 57/264

[58] Field of Search ..... 57/75, 262, 264, 57/265

[56] References Cited

U.S. PATENT DOCUMENTS

| | | | |
|---|---|---|---|
| 3,498,039 | 3/1970 | Kent et al. | 57/264 |
| 3,638,412 | 2/1972 | Rebsamen | 57/264 |
| 3,672,143 | 6/1972 | Whitney | 57/265 |
| 3,789,595 | 2/1974 | Benstein et al. | 57/264 |
| 3,803,822 | 4/1974 | Mulligan | 57/265 |
| 3,902,308 | 9/1975 | Bernstein et al. | 57/265 |
| 3,945,181 | 3/1976 | Yamazaki et al. | 57/264 |
| 4,091,368 | 5/1978 | Schwartz | 340/259 |
| 4,112,665 | 9/1978 | Werst | 57/81 |
| 4,122,657 | 10/1978 | Felix | 57/81 |
| 4,152,931 | 5/1979 | Mannhart | 73/160 |
| 4,404,791 | 9/1983 | Wolf et al. | 57/264 |
| 5,333,441 | 8/1994 | Naegele | 57/264 |

FOREIGN PATENT DOCUMENTS

| | | | |
|---|---|---|---|
| 0 286 046 | 10/1988 | European Pat. Off. . | |
| 25 58 297 | 6/1977 | Germany . | |
| 27 50 153 | 9/1978 | Germany . | |
| 3237371 | 9/1983 | Germany | 57/264 |
| 62-154915 | 7/1987 | Japan . | |
| 89/00215 | 6/1989 | WIPO | 57/264 |

*Primary Examiner*—William Stryjewski

*Attorney, Agent, or Firm*—Burns, Doane, Swecker & Mathis

[57] ABSTRACT

Apparatus for monitoring yarns on spinning machines includes a sensor which is disposed such that it can travel along a track in front of the production stations. In order to permit each spinning station of a spinning machine to be monitored to an extent such that mavericks and other forms of unevenness in the yarn can be located, the sensor (2) is formed and disposed to detect the diameter of the yarn.

16 Claims, 3 Drawing Sheets

DEVICE FOR MONITORING YARNS ON RING SPINNING MACHINES

FIELD OF THE INVENTION

The invention relates to monitoring yarns in spinning machines. It is concerned particularly with a monitoring system in which a sensor is disposed so that it can travel along a track in front of the production stations of a multistation yarn spinning machine to sense in sequence the diameters of the yarns being formed at the various stations as it moves past them.

BACKGROUND OF THE INVENTION

The unevenness of yarn is one of the most important parameters of yarn quality control in the spinning mill. This quality control has until now been carried out almost exclusively in the laboratory on the basis of random samples. However, the procedures now in general use are not well suited to prompt identification of so-called mavericks, i.e. places in which the yarn deviates significantly from the desired diameter. Such mavericks are a frequent occurrence and can only be detected if all the production stations are subject to a control. However a comprehensive quality control directly at each production station is absolutely unrealistic.

It is now usual to use so-called traveling sensors to detect the number of thread breakages at each spinning station. While, the number of thread breakages at the individual spinning stations gives an indication of possible mavericks, the detection of breakage events alone does not adequately address the problem.

A device for monitoring a consecutive series of work stations of a textile machine for thread breakage is known in particular from U.S. Pat. No. 4,122,657. In this system, a scanning head is guided past the work stations on a guide bar for contactless recording of electrical signals. This traveling sensor or scanning head reacts according to a magnetic principle to the rotation of the ferromagnetic traveler of the ring spinning machine work station. This gives rise to a disadvantage. Since the sensor responds to stoppage of the traveler and this only occurs when the ballooning thread, as a result of a break, no longer propels the traveler around the ring, the system determines only thread breakage. In particular, it delivers no information on the quality of the spun yarn, for it does not react to the yarn as such.

For practical reasons quality control in the laboratory does not take place until several days after the random samples have been taken. The possibility of a prompt reaction to any changes of a general type is therefore limited.

SUMMARY OF THE INVENTION

An object of the present invention is to provide apparatus with which each spinning station of a ring spinning machine can be monitored to an extent such that mavericks and other forms of unevenness in the yarn can be located. In accordance with the invention a so-called traveling sensor is guided along a track past the production or spinning stations and comprises a special measuring member for determining the yarn cross section and/or yarn diameter. For this purpose the rotating yarn, in particular the so-called balloon, is illuminated and the yarn then gives rise to light changes which are converted at least approximately into an instantaneous value of the yarn diameter and/or yarn cross section as the traveling sensor travels past each spinning station. Features from which the quality of the yarn can be determined can now be calculated from the yarn diameter or the yarn mass thus determined.

The system according to the invention therefore comprises a traveling sensor with at least one measuring member which is adapted to determine the diameter or the mass. For example, at least one light source and at least one light receiver are provided in the region of the rotating yarn to detect the yarn cross section and/or the yarn diameter.

The invention provides the advantage that spindles which produce yarn with mavericks can be detected after just a short period in a multistation ring spinning machine. This means that it is no longer necessary to undertake a complex yarn examination for mavericks and results can be obtained far quicker. Moreover, all spinning stations are systematically covered to an equal degree, so that the possibility of a practically continuous detection of mavericks and other forms of unevenness in the yarn can be relied on. The proposed apparatus is also very simple and therefore inexpensive. It can also be rendered automatic without any problems.

BRIEF DESCRIPTION OF THE DRAWINGS

The invention is illustrated in detail in the following on the basis of an example and with reference to the accompanying figures, in which.

DETAILED DESCRIPTION OF PREFERRED EMBODIMENTS

Figure 1:
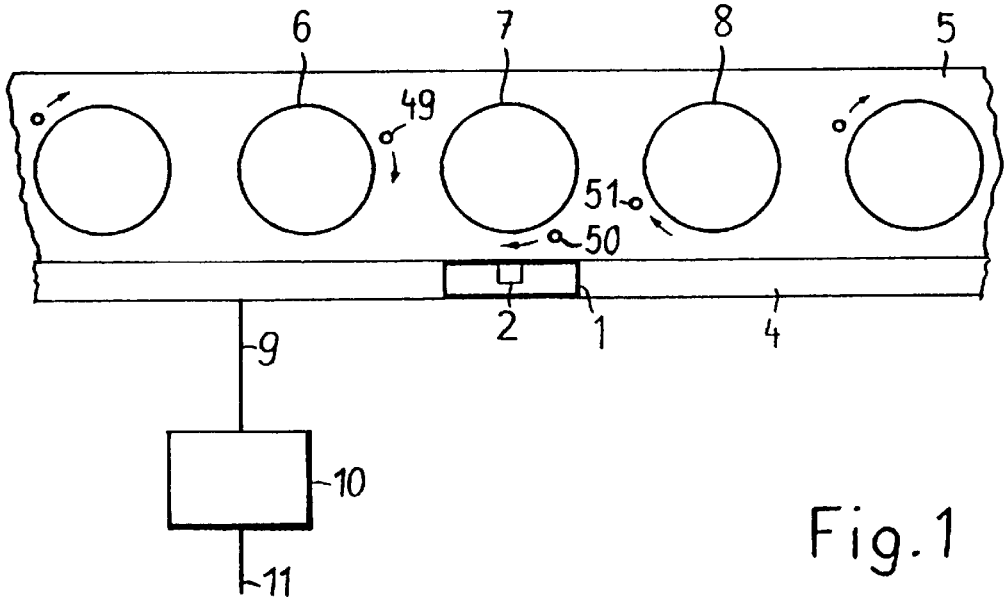
FIG. 1 is a diagrammatic view of the device according to the invention.

FIG. 1 is a diagrammatic view of a traveling sensor 1 with a measuring member 2 which slides on a bar 4 or a track along a ring rail 5 with spinning or production stations 6, 7 and 8. The typical parts of a ring spinning machine, as well as the traveling sensors for detecting thread breakages, are assumed as known from U.S. Pat. No. 4,122,657, and the disclosure of such patent is incorporated by reference herein in its entirety. The traveling sensor 1 is connected via a line 9 to an evaluation unit 10, which also comprises an output 11, for example for the output of mavericks or other values representing the quality of the yarn. The electrical signals are transmitted from the traveling sensor 1 to the line 9 either via the drive of the traveling sensor, as described in the above-mentioned U.S. Pat. No. 4,122,657, or via the conductive bar 4.

FIG. 2 again shows some of the elements shown in FIG. 1, i.e. in particular a spinning station 7 with a bobbin 12, the ring rail 5 with a ring 13 and a traveler 14, the bar 4 with the traveling sensor 1, as well as the measuring member 2. Also in evidence here is the yarn 15, which forms the known balloon 16.

Figure 3:
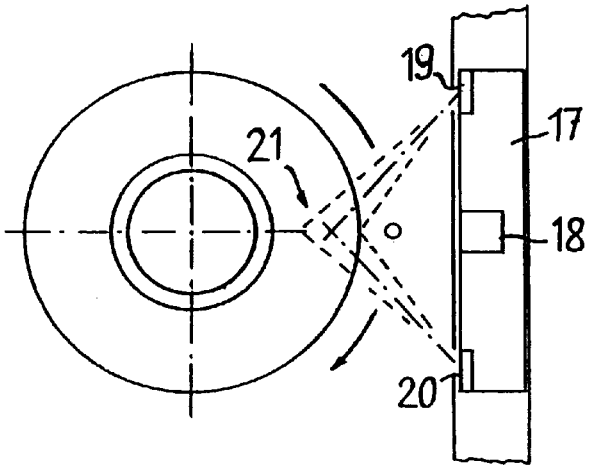
FIGS. 3, 4 and 5 are plan views of a respective construction.

FIG. 3 shows a construction of a traveling sensor 17 with an optically operating measuring member 18 and light sources 19 and 20 which are disposed on either side of this member and are directed such that the surface 21 of a bobbin is illuminated.

Figure 4:
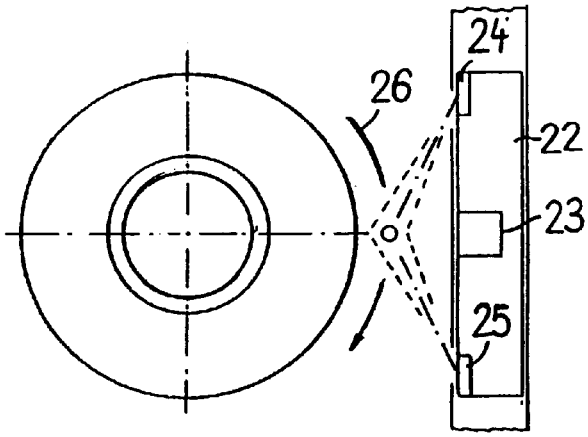

FIG. 4 shows a construction of a traveling sensor 22 with an optically operating measuring member 23 and light sources 24 and 25 which are disposed on either side of this member and are directed such that the path 26 or the balloon of a spinning station is illuminated.

Figure 5:
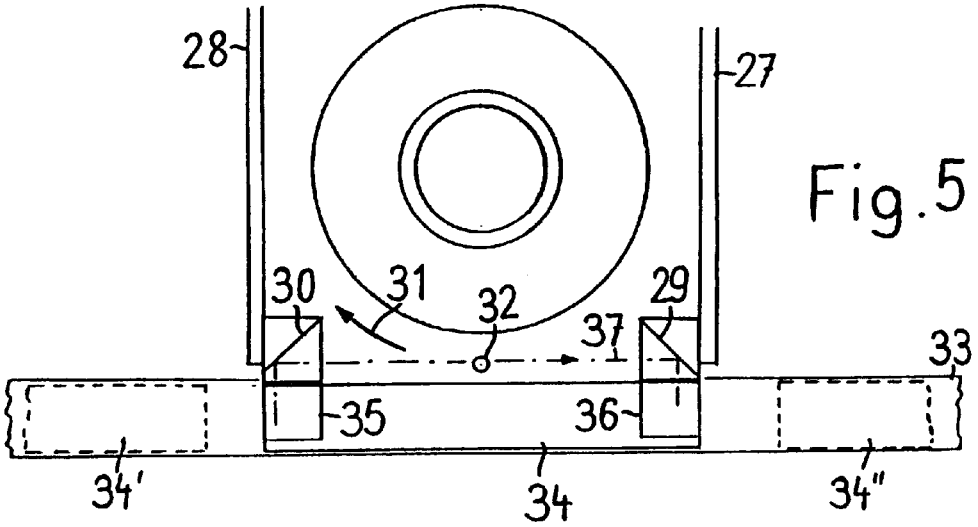

FIG. 5 shows a spinning station with separators 27, 28 and stationary reflector elements 29, 30 attached to the latter. Also to be seen are the path 31 of the yarn 32 and the bar 33 with a traveling sensor 34 and other positions 34' and 34" which it occupies temporarily as it passes by. A transmitter 35 and a receiver 36 for waves, preferably light waves, are provided on the traveling sensor 34. In the illustrated construction, the housing for each of the reflector elements 29 and 30 has a transparent face at the side toward the path for the sensor 34 through which light may pass. Similarly, the housing for each of the transmitter 35 and the receiver 36 has a transparent face on its side toward the bobbin. In the illustrated position of the sensor, these transparent faces of the transmitter 35 and the reflector 30 are opposite one another and the transparent faces of the receiver 36 and the reflector 29 are opposite one another.

Figure 6:
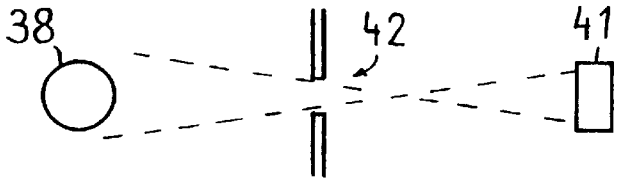
FIGS. 6 and 7 each show a detail of the device.

FIG. 6 is a diagrammatic representation of the operating mode of a receiver or measuring member 41, which cooperates with a gap 42 lying in front.

Figure 7:
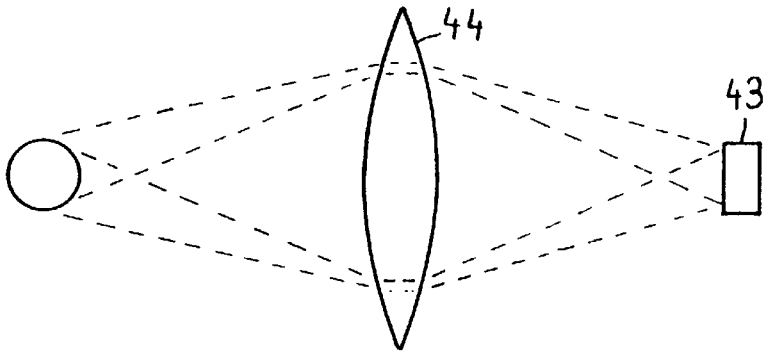

FIG. 7 is a diagrammatic representation of the operating mode of a receiver or measuring member 43, which cooperates with a lens or an objective 44 lying in front.

Figure 8:
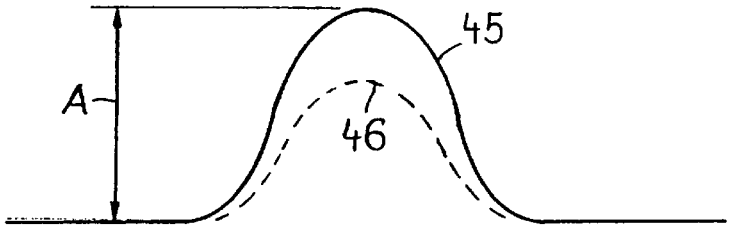
FIGS. 8 and 9 show a respective signal pattern as may occur in the device.

FIG. 8 shows pulses 45, 46 of differing amplitude A which are proportional to the diameter of a yarn. The pulses 45, 46 are accordingly signals as can be delivered by the measuring member.

Figure 9:
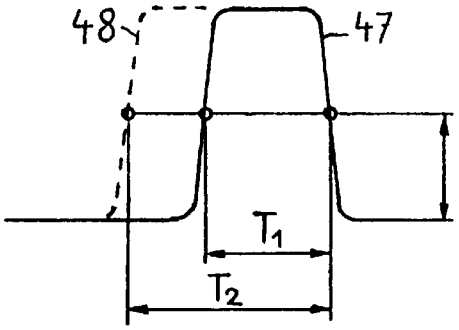

FIG. 9 shows pulses 47, 48 of differing length which are also proportional to the diameter of a yarn. The pulses 47, 48 are accordingly signals as can be delivered by the measuring member.

The operation of the system of this invention will now be described with reference to FIG. 1. As it travels past the spinning stations 6, 7, 8, the measuring member 2 in the traveling sensor 1 directly detects the yarn 49, 50, 51 rotating about the spindle rather than detecting the traveler. A measured value corresponding at least approximately to the yarn diameter or yarn cross section is in each case derived from this. A measuring member of this kind therefore basically always only detects one measuring point per revolution of the yarn about the spindle and only when traveling past in front of the spindle in question. However the mavericks can be detected through an appropriate statistical evaluation of the measurement results in the evaluation unit 10, which therefore consists of a digital processor which can be programmed accordingly.

The principle of the rotation of the yarn giving rise to a change in the light received in a receiver in a traveling sensor is a feature common to all the possible solutions described in the following. In this respect the change in the received light must correlate well with the yarn diameter and therefore also with the yarn cross section.

Figure 2:
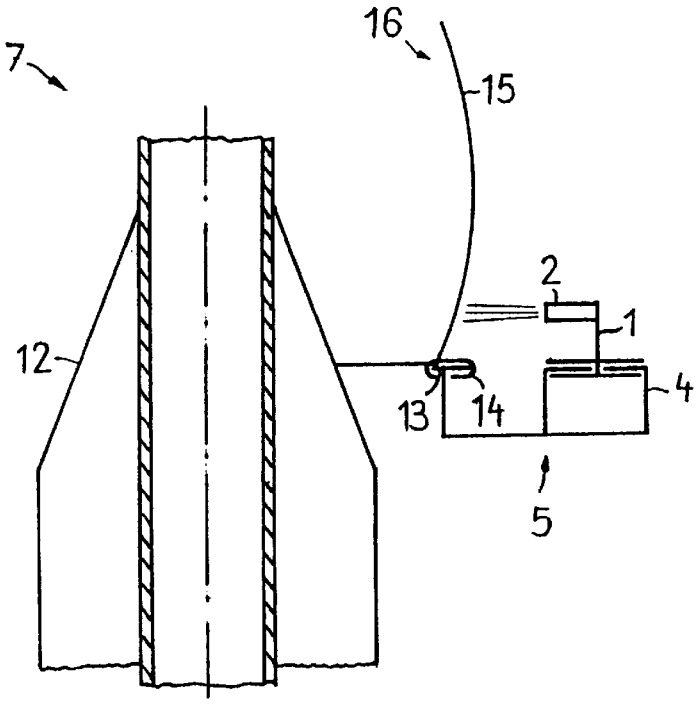
FIG. 2 is a section through a part of the device.

A first example of a special measuring member for detecting the yarn diameter is shown in FIGS. 2 to 4. Here the yarn is illuminated above the ring 13 by at least one, although preferably by two intersecting light sources 19, 20 (FIG. 3) or 24, 25 (FIG. 4). The range of the light beams is indicated by broken lines in FIGS. 3 and 4. A light-sensitive measuring member 23 (FIG. 4) is formed such that it only receives the light reflected from the yarn at a very short range. However the measuring member 18 according to FIG. 3 receives the light shaded by the yarn at a short range. The yarn to be measured may also appear as though it were viewed only through a narrow slot, as indicated by the arrangement according to FIG. 6. In this case the yarn 38 radiates its reflected light through the gap 42 onto the measuring member 41, which here is formed as a photocell, for example.

An optical system 44 with at least one lens, as basically represented in FIG. 7, is better than a gap. The theory of the optical system is known and therefore needs no further explanation.

A pulse is produced each time the yarn revolves. Two different evaluation methods are possible, according to the apparent width of the gap 42. If the yarn is always thinner than the gap width, this will result in a pulse as typically indicated in FIG. 8. The amplitude A of the pulse increases with the yarn diameter. However, when the yarn diameter is always greater than the gap width, this will result in a typical pulse pattern according to FIG. 9. In this case the time T1, T2 is a measure of the yarn diameter. The variant with the time measurement is more favorable for signal processing in digital processors.

FIG. 3 shows another possibility for detecting the yarn diameter. Here the spinning cop is illuminated at its surface 21 behind the rotating yarn instead of the yarn. The yarn is not illuminated by the light beams. It remains in the shadow thereof. The spinning cop reflects light onto the measuring member, the optical system of which may in principle be of the type of the preceding example. In contrast to the preceding example, however, here the reflected light is shaded by the yarn. In this case the shading pulse is evaluated instead of a light pulse, as in the preceding example.

In order to prevent influences due to extraneous light, it is advantageous to use, e.g. infrared light, or to modulate the light of the light transmitters 19 to 25 and demodulate it again following reception.

FIG. 5 shows another embodiment, in which the light from the light transmitter 35 is deflected via reflector elements 30, 29 to the light receiver 36. Two reflectors 29 and 30 are used in the example in FIG. 5. The light receiver 36 again just has a gap. In this example the light beam is attenuated or completely interrupted by the rotating yarn. The statements relating to the above examples also apply to the pulses and optical system here. The speed at which the traveling sensor 34 is moved is of course much lower than the speed at which the yarn rotates about the bobbin. The illustrated position, in which the yarn 32 enters the light beam, will therefore occur at least once per pass of the traveling sensor 34.

When the traveling sensor approaches the spindle, the pulses produced will initially be just weak, these then becoming increasingly stronger until they reach a maximum when the traveling sensor lies directly in front of the spindle. Afterwards the pulses become weaker again. An entire sequence of light pulses is therefore produced. In order to obtain reproducible values in all cases, just the maximum value, for example, or the mean value of a pair of pulses before and after the maximum value should in each case be considered as the actual measured value.

The above constructions show how it is possible to obtain an individual measured value per spindle in each case. These measured values may now be stored in a known manner for each spindle. The variance can then be calculated from these measured values. Those spindles at which the variance is the greatest are identified as the spindles which produce mavericks in the yarn.

The measured values may be averaged per pass of the traveling sensor along the entire ring spinning machine.

It is thus possible to follow the variation in time of the unevenness for each ring spinning machine side. Changes as may occur, for example, due to climatic disturbances, fluctuations in the raw material, etc. can be directly located in this way, in contrast to conventional random sampling with subsequent examination in the laboratory.

What is claimed is:

1. Apparatus for monitoring yarns on a spinning machine having a plurality of production stations, said apparatus comprising a track (4) extending along said production stations, a traveling sensor moveable along said track for sensing a yarn being produced at each of said production stations and producing signals in response thereto, and means for obtaining a measure of the diameter of said yarns based on said signals.

2. Apparatus according to claim 1, wherein said traveling sensor comprises an optical member (2).

3. Apparatus according to claim 1, further comprising a ring rail (5), wherein said traveling sensor is disposed above said ring rail (5) in the region of a balloon (16).

4. Apparatus according to claim 1, further comprising an evaluation unit (10) connected to said sensor.

5. Apparatus according to claim 1, wherein said traveling sensor comprises light sources (19, 20, 24, 25, 35).

6. Apparatus according to claim 1, wherein said traveling sensor comprises a receiver (36).

7. Apparatus according to claim 1, additionally comprising stationary reflector elements (29, 30) associated with the traveling sensor (1) for each spindle.

8. Apparatus according to claim 6, wherein said light sources are modulated.

9. Apparatus according to claim 2, wherein said measuring member is formed to evaluate light changes caused by the rotating yarn.

10. A spinning machine comprising:

a plurality of production stations for producing yarn on a spindle;

a track extending along said plurality of production stations;

a sensor movable along said track for detecting yarn being produced at each of said plurality of production stations; and a device for obtaining a measure of a diameter of the yarn being produced at each of said plurality of production stations based on a signal from said sensor at each of said plurality of production stations.

11. The spinning machine of claim 10, further comprising at least one light source, said sensor being an optical sensor.

12. The spinning machine of claim 10, further comprising a ring rail, said sensor being located above said ring rail.

13. The spinning machine of claim 10, further comprising a light source for modulating light.

14. The spinning machine of claim 10, further comprising at least one light source and a plurality of reflectors.

15. The spinning machine of claim 10, wherein said device is configured and adapted to obtain the measure of the diameter of the yard being produced at each of said production stations based on an amplitude of at least one signal pulse from said sensor.

16. The spinning machine of claim 10, wherein said device is configured and adapted to obtain the measure of the diameter of the yard being produced at each of said production stations based on a duration of at least one signal pulse from said sensor.

* * * * *